US008146912B2

(12) United States Patent
Shimazu

(10) Patent No.: US 8,146,912 B2
(45) Date of Patent: Apr. 3, 2012

(54) RECORDING MEDIA SEPARATING DEVICE AND RECORDING APPARATUS

(75) Inventor: Masamitsu Shimazu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 891 days.

(21) Appl. No.: 12/190,765

(22) Filed: Aug. 13, 2008

(65) Prior Publication Data

US 2009/0047049 A1 Feb. 19, 2009

(30) Foreign Application Priority Data

Aug. 14, 2007 (JP) ..... 2007-211246

(51) Int. Cl.
*B65H 3/52* (2006.01)
*B65H 3/54* (2006.01)

(52) U.S. Cl. ..... 271/121; 271/167; 271/127

(58) Field of Classification Search ..... 271/121, 271/122, 124, 167
See application file for complete search history.

(56) References Cited

U.S. PATENT DOCUMENTS

| | | | | |
|---|---|---|---|---|
| 7,100,914 | B2 * | 9/2006 | Ramos | 271/121 |
| 7,226,048 | B2 * | 6/2007 | Connors et al. | 271/121 |
| 7,422,206 | B2 * | 9/2008 | Okuda et al. | 271/121 |
| 7,624,979 | B2 * | 12/2009 | Masutani | 271/167 |
| 7,748,699 | B2 * | 7/2010 | Nakashima | 271/122 |
| 7,832,722 | B1 * | 11/2010 | Huang | 271/121 |
| 2002/0175462 | A1 * | 11/2002 | Sonoda et al. | 271/121 |
| 2006/0071400 | A1 * | 4/2006 | Johnson et al. | 271/121 |
| 2009/0039591 | A1 * | 2/2009 | Taniguchi | 271/167 |

FOREIGN PATENT DOCUMENTS

| | | |
|---|---|---|
| JP | 08-081078 | 3/1996 |
| JP | 09-240868 | 9/1997 |
| JP | 10-167502 | 6/1998 |
| JP | 10-226428 | 8/1998 |
| JP | 2003-285936 | 10/2003 |
| JP | 2003-321138 | 11/2003 |
| JP | 2005-041628 | 2/2005 |

* cited by examiner

*Primary Examiner* — Kaitlin Joerger
(74) *Attorney, Agent, or Firm* — Workman Nydegger

(57) ABSTRACT

A recording media separating device that separates recording media fed by a feeding roller and a hopper into a top recording medium and next-to-top recording media is provided. The recording media have been held in a feeding tray before being fed. The recording media separating device includes a movable contact separator having a movable contact separation surface that contacts leading ends of the recording media. When the number of the recording media held in the feeding tray becomes less than a predetermined number, the movable contact separation surface of the movable contact separator is moved to a separation position in a transportation path for the recording media.

7 Claims, 13 Drawing Sheets

RECORDING MEDIA SEPARATING DEVICE AND RECORDING APPARATUS

BACKGROUND

1. Technical Field

The present invention relates to a recording media separating device that separates the top recording medium from the next-to-top recording media, when a feeding roller and a hopper feed recording media held in a feeding tray. The invention also relates to a recording apparatus having the recording media separating device. Examples of recording apparatuses include printers such as serial printers and line printers, facsimiles, and photocopiers.

2. Related Art

An automatic feeder of a recording apparatus has a separating device for separating multi-fed recording media, i.e., for separating the top recording medium needed for recording from the next-to-top (subsequent) recording media. For example, JP-A-2003-321138 discloses a recording media separating device of a contact-separation type. The recording media separating device has an arm-shaped separating member that pivots about the fulcrum to approach and move away from a feeding roller, and a separating spring that strongly urges the free end of the separating member against the circumference of the feeding roller. The separating member has a sloped surface at the free end. The sloped surface contacts the leading ends of recording media and separates the recording media. This recording media separating device produces less noise than known friction-separation type separating devices, which use friction members.

Ink jet printers, which are exemplary recording apparatuses, have contact-separation type separating devices. More specifically, a fixed contact separator 102 as shown in FIGS. 12 and 13, which is formed integrally with a transportation guide member 101 and serves as a preliminary separator, is located upstream of a retard roller or the like, which serves as a main separator. The fixed contact separator 102 is located at the upstream end of the transportation guide member 101. Recording media (hereinafter also referred to as "sheets of paper") P slide over the transportation guide member 101. The transportation guide member 101 guides the sheets of paper P. The fixed contact separator 102 includes a rib member projecting from the top surface of the transportation guide member 101.

The fixed contact separator 102 has a contact separation surface 103 at the front surface thereof. The contact separation surface 103 corresponds to the sloped surface of the separating member disclosed in JP-A-2003-321138. The angle of elevation $\alpha$, i.e., the angle of the contact separation surface 103 with respect to the surface of the transportation guide member 101 serving as the transportation path, is always constant. When multi-fed sheets of paper P contact the contact separation surface 103 of the fixed contact separator 102, the sheets of paper P are separated because of the flexibility of the sheets of paper P and the reactive force exerted by the contact separation surface 103 and produced by sheet-transportation force.

In contact-separation type separating devices, the sheet separation performance largely depends on the angle $\theta$ at which the sheets of paper P contact the contact separation surface 103, and the length L between the nip point N and the contact separation surface 103. As shown in FIG. 12, in the case where the number of sheets of paper P urged by the hopper 104, which is a swingable structure having a pivot fulcrum (not shown) on the upper side, is large, the angle $\theta$ is large ($\theta=\theta$ max). Thus, the reactive force exerted by the contact separation surface 103 is large. Accordingly, the sheet separation performance is stabilized. On the other hand, as shown in FIG. 13, in the case where the number of sheets of paper P urged by the hopper 104 decreases to a few, the angle $\theta$ decreases ($\theta=\theta$ min). This reduces the reactive force exerted by the contact separation surface 103, whereby the sheet separation performance becomes insufficient.

Similarly, as shown in FIG. 12, in the case where the number of sheets of paper P urged by the hopper 104 is large, the length L between the nip point N and the contact separation surface 103 is large (L=L max). The strength of the reactive force exerted by the contact separation surface 103 is appropriate in this state. Thus, the sheet separation performance is stabilized. On the other hand, as shown in FIG. 13, in the case where the number of sheets of paper P urged by the hopper 104 decreases to a few, the length L between the nip point N and the contact separation surface 103 decreases (L=L min). This increases the flexibility of the sheets of paper P. As a result, the reactive force exerted by the contact separation surface 103 becomes relatively small, whereby the sheet separation performance becomes insufficient. Variations in the sheet separation performance of the fixed contact separator 102 and the contact-separation type separating device disclosed in JP-A-2003-321138 were caused mainly by variations in the angle $\theta$ and/or the length L between the nip point N and the contact separation surface 103 according to the number of sheets of paper P.

SUMMARY

An advantage of some aspects of the invention is that it provides a contact-separating type recording media separating device, in which variation in angle at which recording media contact a contact separation surface and variation in the length between the nip point and the contact separation surface according to the number of the recording media held in a feeding tray are minimized to stabilize the recording media separation performance. Another advantage of some aspects of the invention is that it provides a recording apparatus having the recording media separating device.

According to a first aspect of the invention, a recording media separating device that separates recording media fed by a feeding roller and a hopper into a top recording medium and next-to-top recording media is provided. The recording media have been held in a feeding tray before being fed. The recording media separating device includes a movable contact separator having a movable contact separation surface that contacts leading ends of the recording media. When the number of the recording media held in the feeding tray becomes less than a predetermined number, the movable contact separation surface of the movable contact separator is moved to a separation position in a transportation path for the recording media.

According to the first aspect, when the number of the recording media held in the feeding tray becomes less than a predetermined number, the movable contact separation surface of the movable contact separator is moved to a separation position in a transportation path for the recording media. Accordingly, the provision of the movable contact separation surface minimizes variation in the angle at which the recording media held in the feeding tray contact the contact separation surface according to the number of the recording media. Thus, the recording media separation performance is stabilized. Further, variation in the length between the nip point and the contact separation surface can be reduced. This also serves to stabilize the recording media separation performance.

According to a second aspect of the invention, a recording media separating device that separates recording media fed by a feeding roller and a hopper into a top recording medium and next-to-top recording media is provided. The recording media have been held in a feeding tray before being fed. The recording media separating device includes a fixed contact separator having a fixed contact separation surface that contacts leading ends of the recording media. The fixed contact separator is located upstream of a transportation guide member for guiding the recording media from below. The recording media separating device also includes a movable contact separator having a movable contact separation surface that contacts the leading ends of the recording media. The movable contact separator is located downstream of the fixed contact separator. When the number of the recording media held in the feeding tray becomes less than a predetermined number, the movable contact separation surface of the movable contact separator is moved to a separation position in a transportation path for the recording media.

According to the second aspect, in the case where the feeding tray holds a large number of the recording media, multi-fed recording media are separated by the fixed contact separator. In the case where the feeding tray holds a few recording media, multi-fed recording media are separated by the movable contact separator. Depending on the number of the recording media, one of the fixed contact separator or the movable contact separator may be used. Thus, the recording media separation performance is further stabilized.

In the recording media separating device according to the first aspect, it is preferable that the movable contact separation surface be provided at a projection projecting from a free end of the hopper, which is a swingable structure, in the direction in which the hopper extends.

In addition to the advantages obtained by the structure according to the first aspect, this structure provides the advantages described below. The projection and the movable contact separation surface are moved as the hopper pivots. This automatically moves the movable contact separation surface to a proper separation position in the transportation path, according to the number of the recording media on the hopper. Further, this recording media separating device has a simple structure, in which the projection is provided at the free end of the hopper. No complex mechanism is required. Accordingly, the price of the recording media separating device can be reduced.

In the recording media separating device according to the first aspect, it is preferable that, when the movable contact separation surface is positioned at the separation position, the recording media fed by the feeding roller and the hopper contact the contact separation surface of the movable contact separator at an angle within a predetermined range.

In addition to the advantages obtained by the structure according to the first aspect, this structure provides the advantages described below. When the movable contact separation surface is positioned at the separation position, the recording media fed by the feeding roller and the hopper contact the contact separation surface of the movable contact separator at an angle within a predetermined range. This prevents the reactive force exerted by the contact separation surface from becoming extremely small, even when the angle is reduced. Thus, the recording media separation performance of the contact separation surface can be maintained at a high level.

In the recording media separating device according to the first aspect, it is preferable that the movable contact separation surface be elastically supported by an urging member.

In addition to the advantages obtained by the structure according to the first aspect, this structure provides the advantages described below. The movable contact separation surface is elastically supported by the urging member. So, when the leading ends of the recording media contact the movable contact separation surface, the movable contact separation surface is pushed in the direction in which the recording media advance and quickly returned to its original position. As a result, the leading ends of the recording media are separated, whereby the recording media separation performance is further improved.

In the recording media separating device according to the first aspect, it is preferable that the recording media separating device further include a main separator located downstream of the movable contact separator in a recording media transportation direction.

In addition to the advantages obtained by the structure according to the first aspect, this structure provides the advantages described below. The provision of the main separator allows the movable contact separator to be used as a preliminary separator. This improves the preliminary separation performance, and reduces the workload of the main separator. Accordingly, the recording media can be assuredly separated. In particular, when the preliminary separator has both the fixed contact separator and the movable contact separator, the preliminary separation performance is further stabilized and is maintained at a high level.

According to a third aspect of the invention, a recording apparatus includes a feeding tray capable of holding a stack of recording media, a hopper that urges the recording media held in the feeding tray toward a feeding roller, the feeding roller that cooperates with the hopper to pick up upper recording media, and a recording media separating device that separates the upper recording media into a top recording medium and next-to-top recording media. The recording media separating device is the recording media separating device according to the first aspect.

According to the third aspect, a recording apparatus such as an ink jet printer has the advantages obtained by the structure according to the first aspect. In such a recording apparatus, recording media are prevented from being multi-fed into a transportation path, and are smoothly transported.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording media separating device and a recording apparatus having the recording media separating device according to embodiments of the invention will be described below. First, the overall structure of an ink jet printer 100, which is a preferable embodiment of the recording apparatus of the invention, will be described with reference to the drawings.

Figure 1:
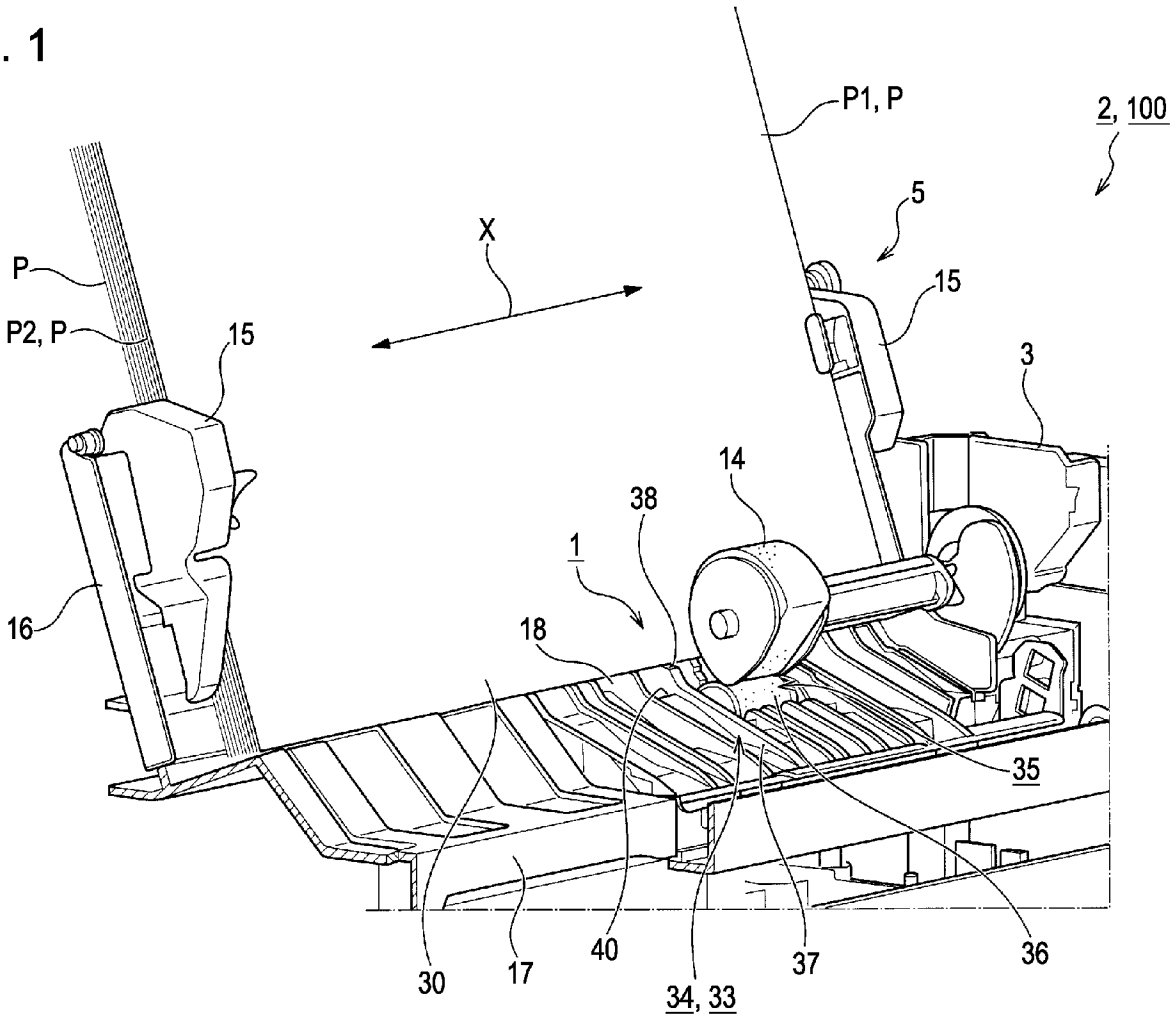
FIG. 1 is a perspective view of an automatic feeder of the invention, in which a feeding tray holds a large number of sheets of paper.
Figure 2:
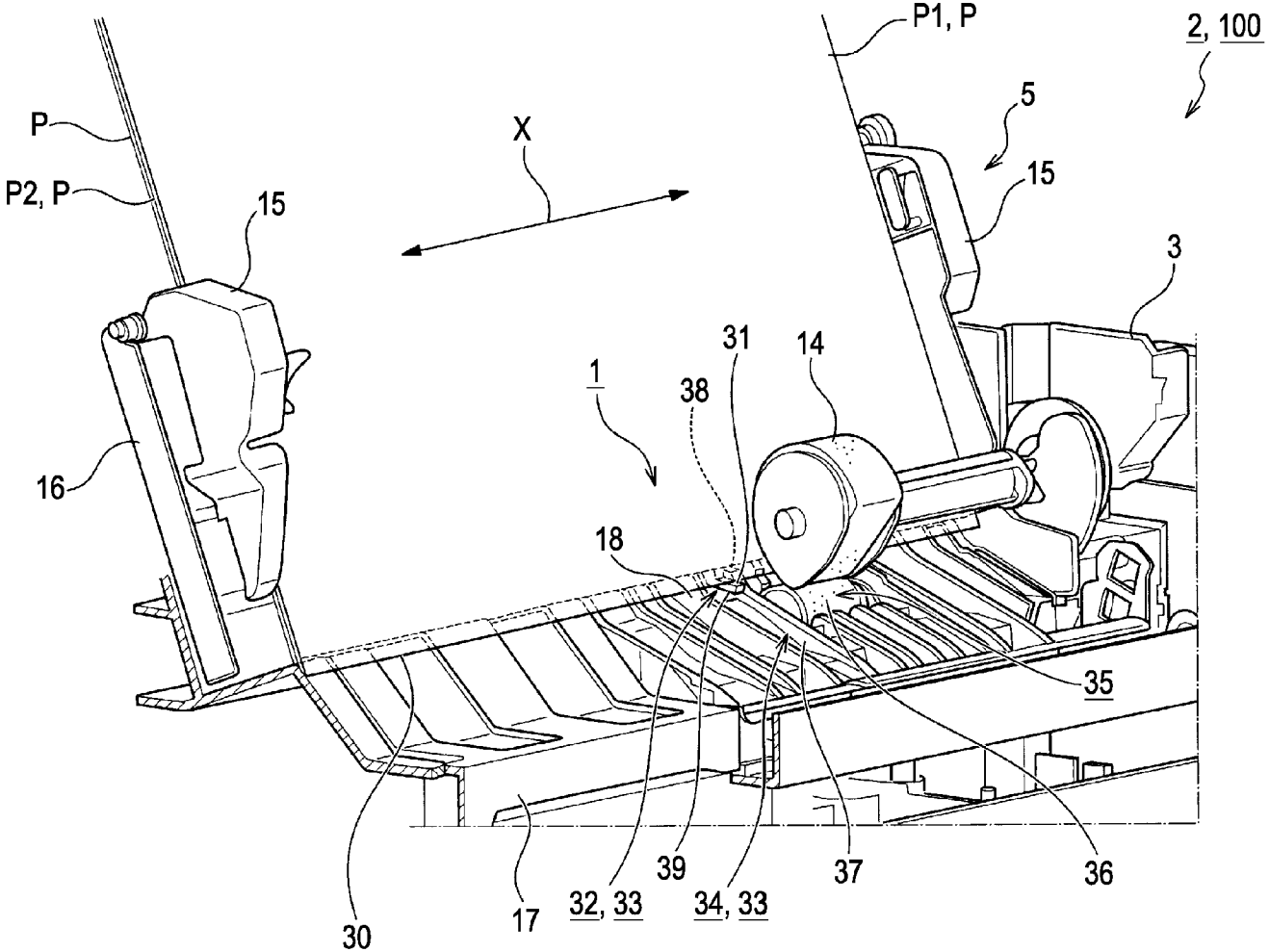
FIG. 2 is a perspective view of the automatic feeder of the invention, in which the feeding tray holds a few sheets of paper.

FIG. 1 is a perspective view of an automatic feeder of an ink jet printer, in which a feeding tray holds a large number of sheets of paper. FIG. 2 is a perspective view of an automatic feeder of an ink jet printer, in which the feeding tray holds a few sheets of paper. The ink jet printer 100 has a printer body 3, which is an exemplary recording apparatus body. An automatic feeder 2 is provided at the rear side of the printer body 3.

The automatic feeder 2 basically includes a feeding tray 5 capable of holding a large number of sheets of paper P, a hopper 16 that urges the sheets of paper P in the feeding tray 5 toward a feeding roller 14, the feeding roller 14 that cooperates with the hopper 16 to pick up upper sheets of paper P in the feeding tray 5, by pressing the sheets of paper P therebetween, a recording media separating device 1 for separating the upper sheets of paper P into the top sheet P1 needed for recording and the next-to-top sheets P2, and a returning unit (not shown) for returning the next-to-top sheets P2 to the feeding tray 5, after being separated from the top sheet P1 by the recording media separating device 1.

A transportation guide member 17 that supports and guides the sheets of paper P from below is located downstream of the nip point N between the feeding roller 14 and the sheets of paper P urged upward by the hopper 16, in the paper transportation direction Y. The recording media separating device 1 of the invention and the returning unit (not shown) are provided on the transportation guide member 17. A plurality of guide ribs 18 that extend in the paper transportation direction Y are formed on the top surface of the transportation guide member 17. The space above the guide ribs 18 serves as a transportation path 19 for the sheets of paper P (refer to FIGS. 4 to 11).

The sheets of paper P in the feeding tray 5 are caused to pass between the feeding roller 14 and the hopper 16, while the left and right edges thereof are guided by edge guide members 15. The recording media separating device 1 separates the sheets of paper P into the top sheet P1 and the next-to-top sheets P2. The returning unit (not shown) returns the next-to-top sheets P2 to the feeding tray 5. The transportation guide member 17 guides the top sheet P1. Thus, the sheets of paper P are automatically fed on a piece-by-piece basis.

The sheets of paper P are guided along the transportation path 19 and fed between a pair of nip rollers (not shown) called transportation rollers. The transportation rollers guide the sheets of paper P to a recording position where recording is performed. A recording head (not shown) for performing recording, a carriage (not shown) for reciprocating the recording head in the direction X, and a platen (not shown) for supporting the sheets of paper P from below and defining a gap between the recording head and the sheets of paper P are provided in the recording position. The recorded sheets of paper P pass between a pair of nip rollers (not shown) called output rollers, and are output and stacked on a holding surface of an output stacker (not shown) positioned at the downstream end in the paper transportation direction Y.

First Embodiment

A recording media separating device 1 according to a first embodiment of the invention, provided in the above-described ink jet printer 100, will be described below in detail with reference to the drawings.

Figure 3:
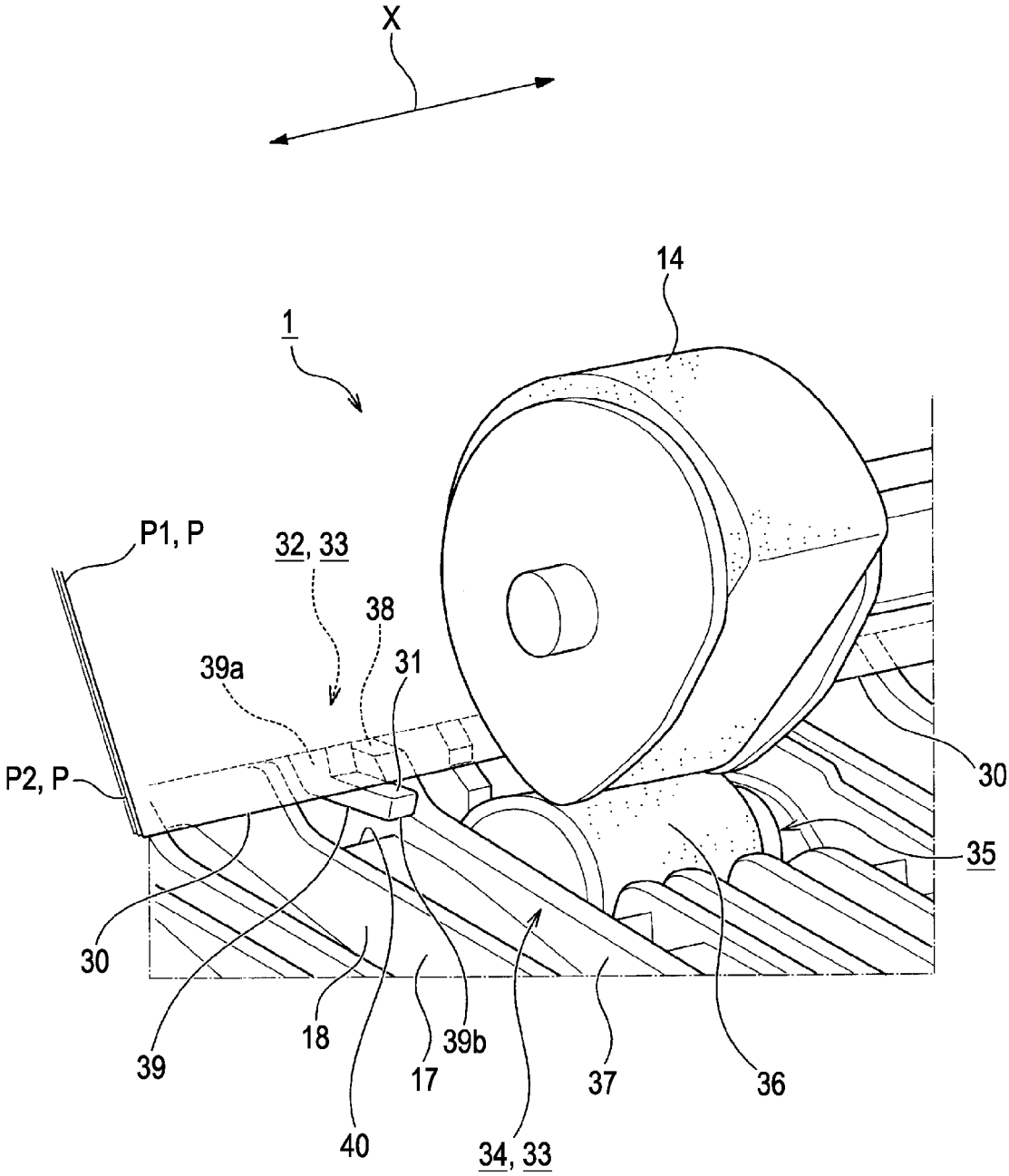
FIG. 3 is a perspective view of a recording media separating device according to a first embodiment of the invention.
Figure 4:
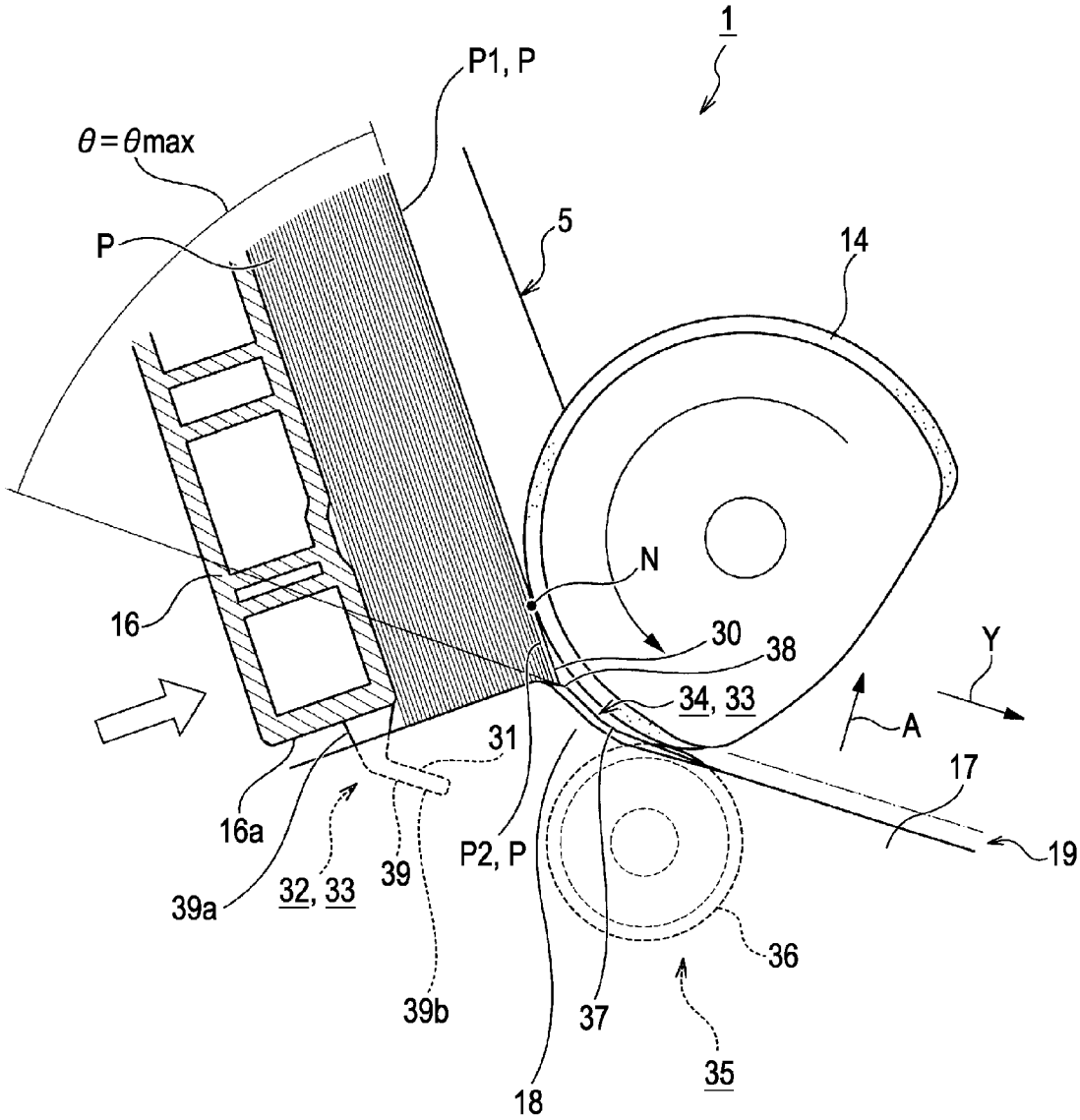
FIG. 4 is a side sectional view of a preliminary separator according to the first embodiment, in which the feeding tray holds a large number of sheets of paper.
Figure 5:
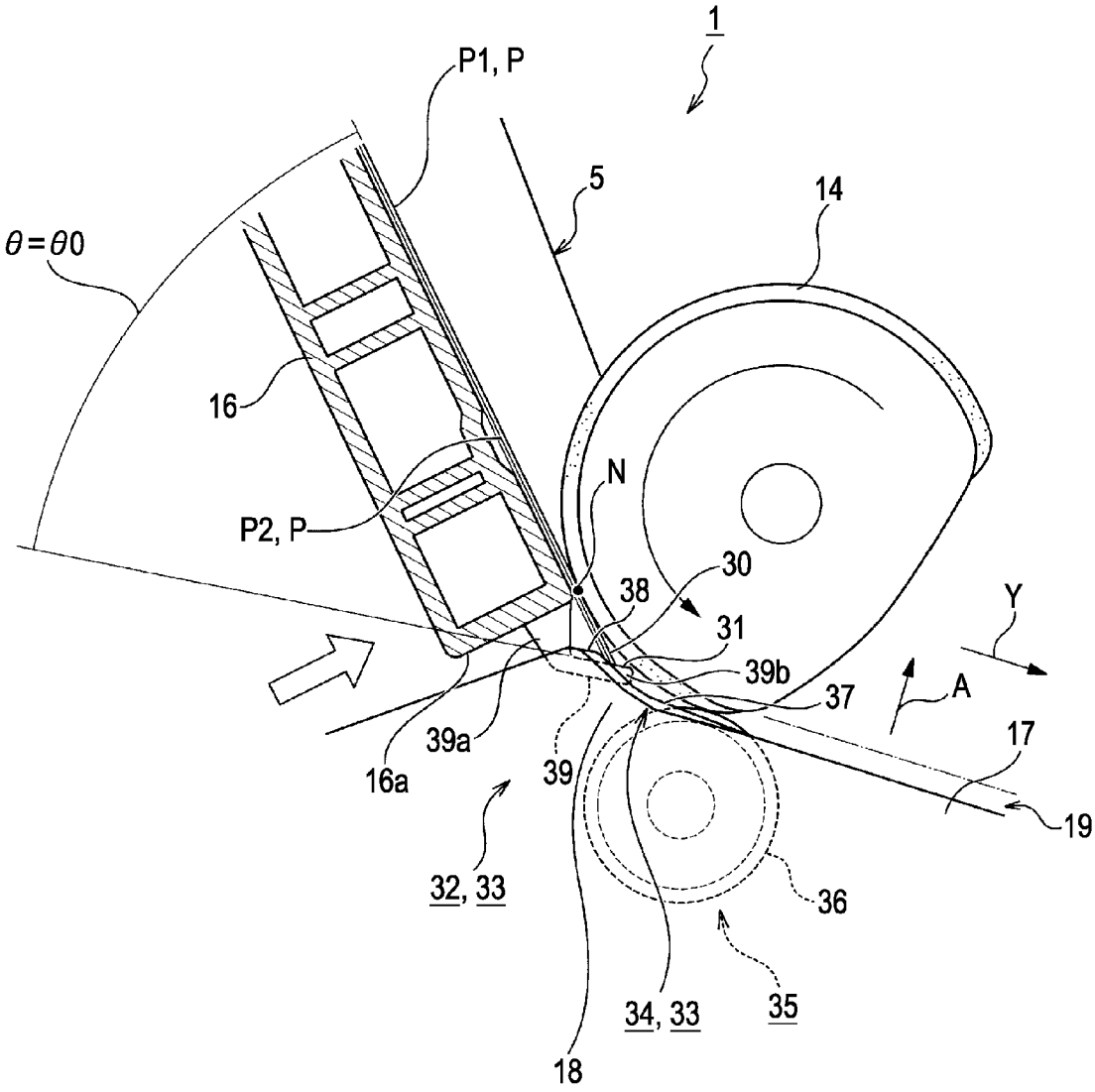
FIG. 5 is a side sectional view of the preliminary separator according to the first embodiment, in which the feeding tray holds a few sheets of paper.
Figure 6:
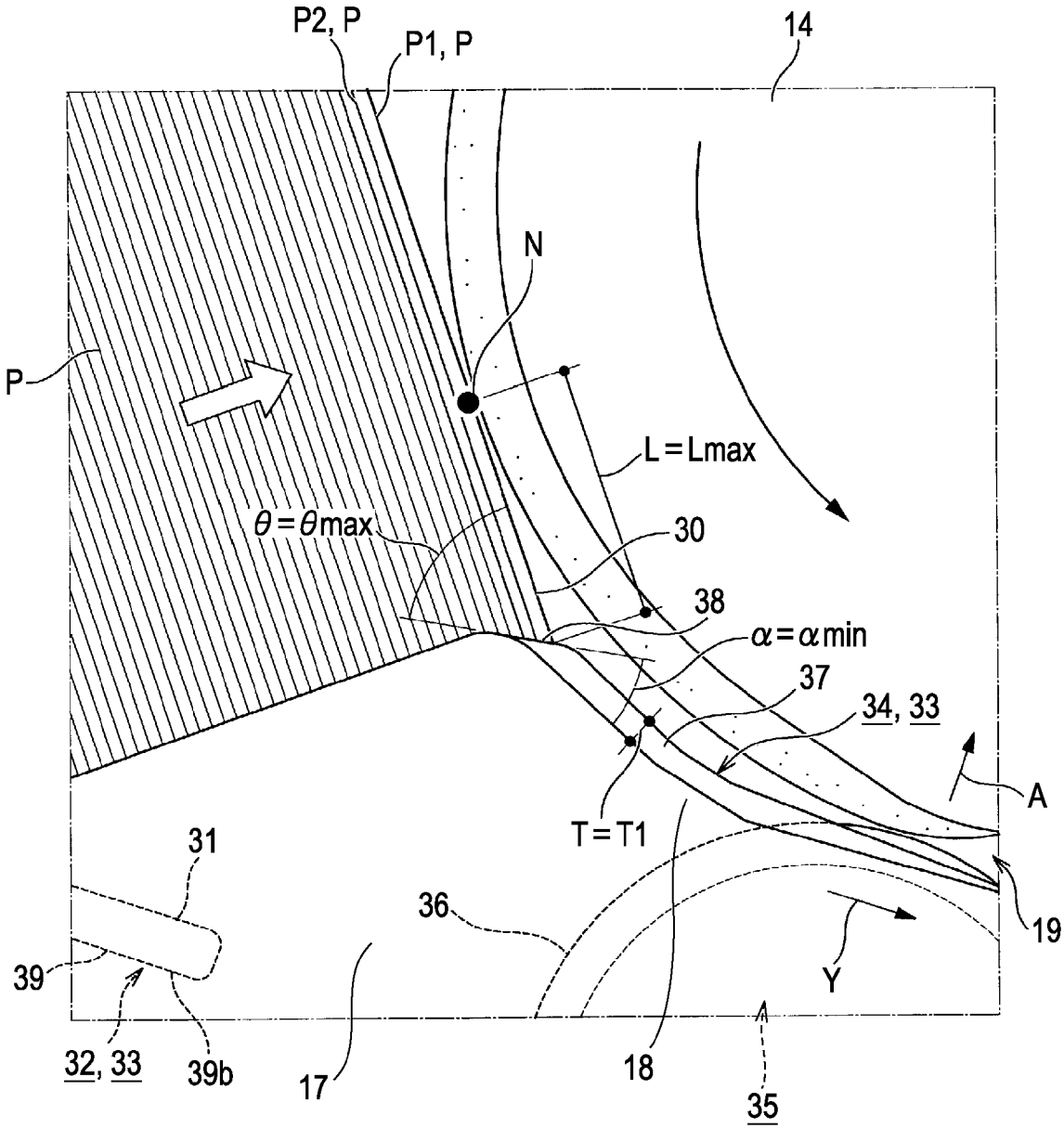
FIG. 6 is a side sectional view of the preliminary separator according to the first embodiment, in an operating state, in which the feeding tray holds a large number of sheets of paper.
Figure 7:
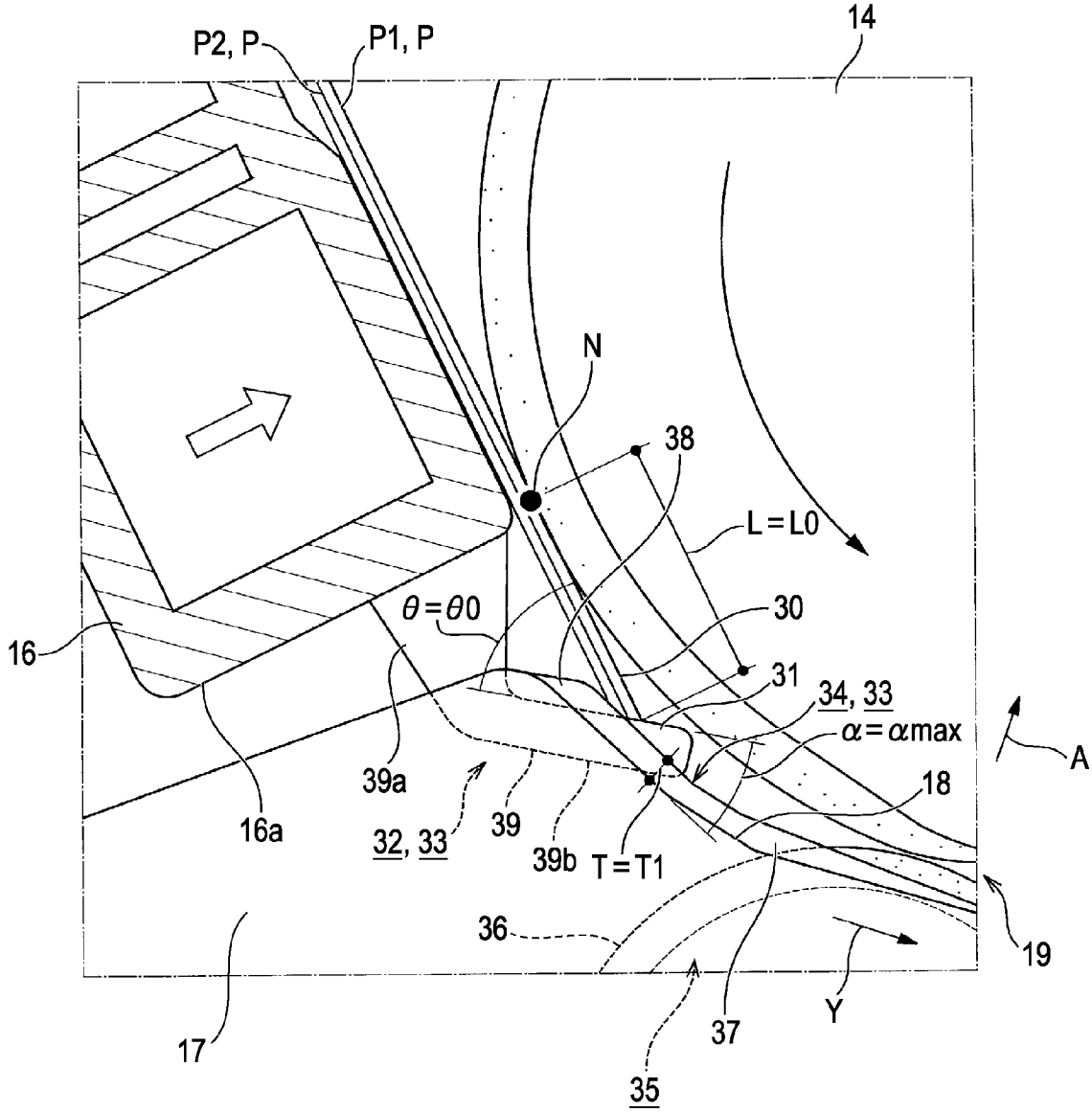
FIG. 7 is a side sectional view of the preliminary separator according to the first embodiment, in an operating state, in which the feeding tray holds a few sheets of paper.

FIG. 3 is a perspective view of the recording media separating device according to the present embodiment. FIG. 4 is a side sectional view of a preliminary separator according to the present embodiment, in which the feeding tray holds a large number of sheets of paper. FIG. 5 is a side sectional view of the preliminary separator according to the present embodiment, in which the feeding tray holds a few sheets of paper. FIG. 6 is a side sectional view of the preliminary separator according to the present embodiment, in an operating state, in which the feeding tray holds a large number of sheets of paper. FIG. 7 is a side sectional view of the preliminary separator according to the present embodiment, in an operating state, in which the feeding tray holds a few sheets of paper.

The recording media separating device 1 according to the present embodiment has movable contact separators 32 having movable contact separation surfaces 31 which contact leading ends 30 of multi-fed sheets of paper P. When the number of sheets of paper P in the feeding tray 5 decreases to a few, the movable contact separation surfaces 31 are moved in the direction A so as to narrow the transportation path 19 for the sheets of paper P. When the number of sheets of paper P in the feeding tray 5 becomes less than a predetermined number, the movable contact separation surfaces 31 of the movable contact separators 32 are moved to a separation position in the transportation path 19 for the sheets of paper P (FIGS. 5 and 7).

The recording media separating device 1 according to the present embodiment includes a preliminary separator 33 located upstream of the transportation path 19 and a main separator 35 located downstream of the preliminary separator 33. The preliminary separator 33 includes fixed contact separators 34 located upstream of the transportation guide member 17 and the movable contact separators 32 located downstream of the fixed contact separators 34.

The main separator 35 finally and assuredly separates the multi-fed sheets of paper P into the top sheet P1 needed for recording and the subsequent sheets P2. According to the present embodiment, a retard roller 36 is used as the main separator 35. The rotational resistance of the retard roller 36 allows only the top sheet P1 to be fed into the transportation path 19.

The preliminary separator 33 preliminarily separates the sheets of paper P to prevent an excessive number of sheets of paper P from being fed to the main separator 35 so that the main separator 35 can assuredly perform main separation. As shown in FIGS. 4 to 7, the fixed contact separators 34 include ridges 37 higher than the guide ribs 18 formed on the top surface of the transportation guide member 17. The top surface serves as the transportation path 19. The ridges 37 extend in the paper transportation direction Y, like the guide ribs 18. The amount of projection T of the ridges 37 is T1. The upstream ends of the ridges 37 form sloped surfaces as shown in FIGS. 4 to 7. The sloped surfaces serve as fixed contact separation surfaces 38 that contact the leading ends 30 of the sheets of paper P. The fixed contact separators 34 are provided on the left and right sides of the retard roller 36, closely thereto.

In FIGS. 4 and 6, the nip point N is the point where the top surface of the sheets of paper P urged upward by the hopper 16 contacts the circumference of the feeding roller 14. The angle θ is the angle at which the sheets of paper P held at the nip point N contact the fixed contact separation surfaces 38. As shown in FIGS. 4 and 6, when the feeding tray 5 holds a large number of sheets of paper P, the angle θ is large. Herein, θ max denotes the angle θ shown in FIGS. 4 and 6.

In FIG. 6, the length L shown by a line segment is the length between the nip point N and the contact separation surfaces 38. When the feeding tray 5 holds a large number of sheets of paper P, as shown in FIGS. 4 and 6, the length L is large. Herein, L max denotes the length L shown in FIGS. 4 and 6. In FIG. 6, the angle of elevation α is the angle of the top surface of the upstream portion of the transportation guide member 17 with respect to the contact separation surfaces 38. The angle of elevation α of the contact separation surfaces 38 of the fixed contact separators 34 is small. Herein, α min denotes the angle of elevation α shown in FIG. 6.

The movable contact separators 32 include projections 39 projecting from a free end 16*a* of the hopper 16 in the direction in which the hopper 16 extends, i.e., in the paper transportation direction Y, as shown in FIGS. 4 to 7. As shown in FIGS. 4, 5, and 7, the projections 39 are substantially V-shaped. Each of the projections 39 includes a base portion 39*a* and an acting portion 39*b*. According to the present embodiment, the projections 39 are provided on the left and right sides of the ridges 37 serving as the fixed contact separators 34, closely thereto. The tips of the acting portions 39*b* of the projections 39 are positioned slightly higher than a recording-media holding surface of the hopper 16. When the feeding tray 5 holds a few sheets of paper P as shown in FIGS. 5 and 7, the tips of the acting portions 39*b* are positioned higher than the ridges 37 and project in the direction A so as to narrow the transportation path 19 for the sheets of paper P.

When the movable contact separation surfaces 31 are positioned at the separation position in the transportation path 19, the sheets of paper P fed by the feeding roller 14 and the hopper 16 contact the movable contact separation surfaces 31 at an angle θ within a predetermined range (an angle close to θ max). This prevents the sheet separation performance from being influenced by a reduction in the number of sheets of paper P. In other words, this prevents the reactive force exerted by the movable contact separation surfaces 31 from becoming extremely small. Thus, the movable contact separation surfaces 31 can constantly exhibit good sheet separation performance.

FIGS. 5 and 7 show the nip point N similar to that shown in FIGS. 4 and 6. In FIGS. 5 and 7, the nip point N is located more downstream in the paper transportation direction Y than that shown in FIGS. 4 and 6. FIGS. 5 and 7 show the angle θ similar to that shown in FIGS. 4 and 6. In FIGS. 5 and 7, the sheets of paper P held at the nip point N contact the movable contact separation surfaces 31 at the angle θ. The angle θ shown in FIGS. 5 and 7 is slightly smaller than that shown in FIGS. 4 and 6 (θ=θ max). Herein, θ0 denotes the angle θ shown in FIGS. 5 and 7.

In FIG. 7, the length L shown by a line segment is the length between the nip point N and the movable contact separation surfaces 31, similarly to FIGS. 4 and 6. The length L shown in FIG. 7 is, for example, L0 that is substantially the same as L max shown in FIG. 6. FIG. 7 shows the angle of elevation α similar to that shown in FIG. 6. The angle of elevation α shown in FIG. 7 is larger than that shown in FIG. 6 (α min). Herein, α max denotes the angle of elevation shown in FIG. 7.

As shown in FIG. 3, recesses 40 that allow the projections 39 to move without interfering with the transportation guide member 17 are provided in the transportation guide member 17, at positions corresponding to the projections 39. The recesses 40 are provided on the left and right sides of the ridges 37.

Operation of the recording media separating device 1 according to the present embodiment will be described below, for the case where the feeding tray 5 holds a large number of sheets of paper P (Case 1), and for the case where the feeding tray 5 holds a few sheets of paper P (Case 2).

Case 1

As shown in FIGS. 4 and 6, in the case where the feeding tray 5 holds a large number of sheets of paper P, the nip point N is located upstream of the fixed contact separation surfaces 38 of the fixed contact separators 34. The leading ends 30 of the sheets of paper P fed by the hopper 16 and the feeding roller 14 contact the contact separation surfaces 38 at a large angle (θ max). The length between the nip point N and the contact separation surfaces 38 is large (L max). The leading ends 30 of the sheets of paper P receive sufficient reactive force from the contact separation surfaces 38, and are accurately separated.

As can be seen from FIGS. 4 and 6, the projections 39 are not positioned in the transportation path 19. Hence, the movable contact separators 32 do not operate. Accordingly, the fixed contact separators 34 perform preliminary separation. The preliminarily separated sheets of paper P move along the transportation path 19 to the retard roller 36 to be subjected to the main separation. Thus, the top sheet P1 is assuredly separated from the subsequent sheets P2.

Case 2

As shown in FIGS. 5 and 7, in the case where the number of sheets of paper P in the feeding tray 5 decreases to a few with the progress of the recording, or, in the case where the feeding tray 5 originally holds a few sheets of paper P for recording, the position of the nip point N is shifted toward the fixed contact separation surfaces 38 of the fixed contact separators 34. As a result, the direction in which the sheets of paper P are fed after leaving the nip point N is changed. Thus, the multi-fed sheets of paper P are fed into the transportation path 19, without the leading ends 30 of the sheets of paper P contacting the contact separation surfaces 38 of the fixed contact separators 34.

However, as shown in FIGS. 5 and 7, the acting portions 39*b* of the projections 39 extend in the transportation path 19. The leading ends 30 of the sheets of paper P contact the movable contact separation surfaces 31 of the movable contact separators 32, and are preliminarily separated. The provision of the movable contact separators 32 prevents the angle θ and the length L between the nip point N and the movable contact separation surfaces 31 from being significantly changed (reduced). Thus, even when the number of sheets of paper P decreases to a few, preliminary separation of the sheets of paper P is stably performed. The preliminarily separated sheets of paper P move along the transportation path 19 to the retard roller 36 to be subjected to the main separation. Thus, the top sheet P1 is assuredly separated from the subsequent sheets P2.

Second Embodiment

The basic structures of the recording media separating device 1 and the recording apparatus 100 having the recording media separating device 1 of the invention have been described above. Of course, the structures may be modified or omitted within the scope of the invention.

Figure 8:
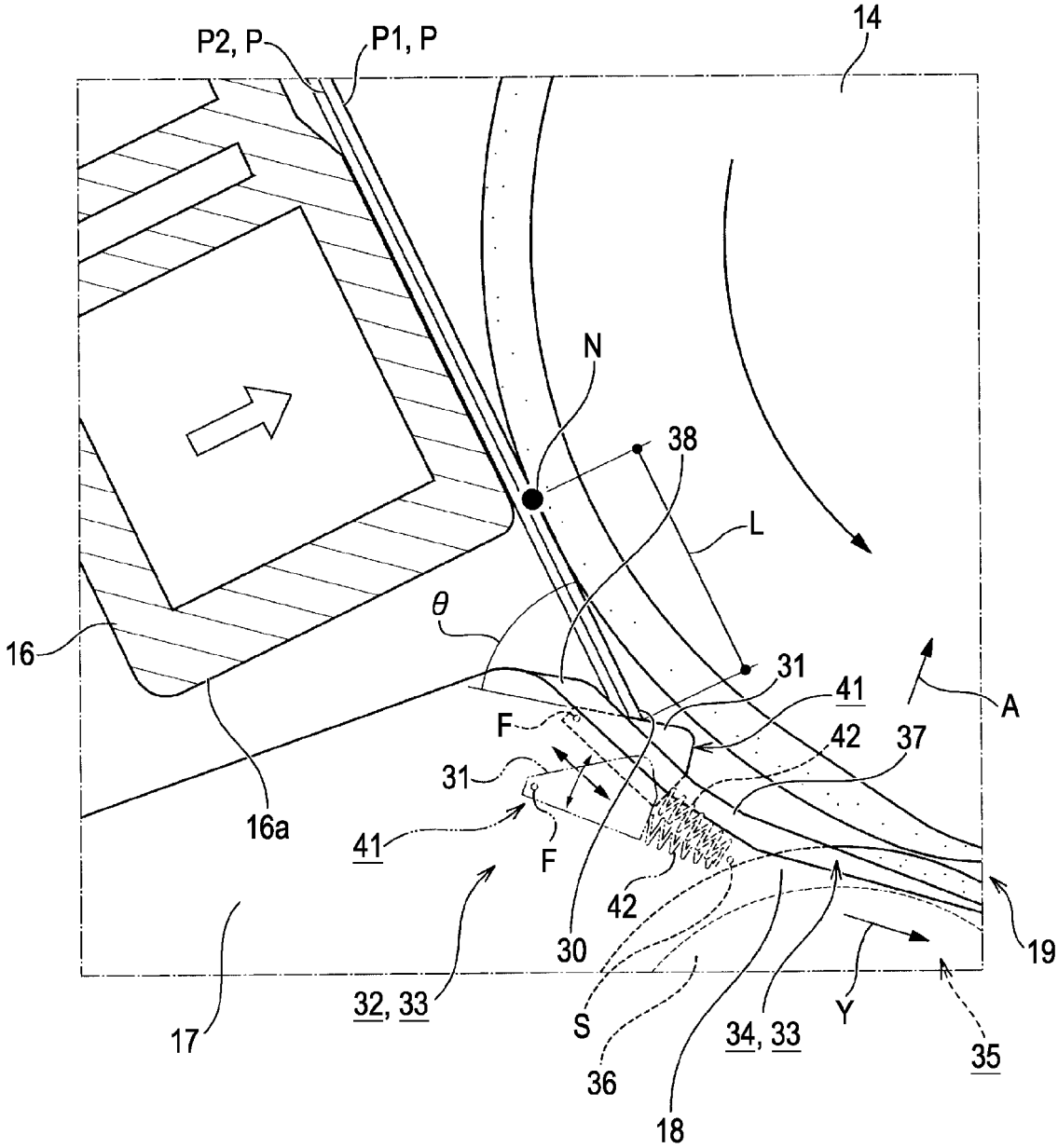
FIG. 8 is a side sectional view of a recording media separating device according to a second embodiment, having a movable contact separation surface.

FIG. 8 is a side sectional view of a movable contact separating device according to a second embodiment of the invention, in which the feeding tray holds a few sheets of paper. FIG. 8 shows an operation of the preliminary separator. The movable contact separators 32 have the movable contact separation surfaces 31, which are elastically supported by springs 42. The springs 42 are exemplary urging members. More specifically, the movable contact separators 32 include slide ribs 41 provided so as to project from the top surface of the transportation guide member 17. The slide ribs 41 are slidable in the paper transportation direction Y. The movable contact separation surfaces 31 are formed on the slide ribs 41. The springs 42 constantly urge the slide ribs 41 toward upstream in the paper transportation direction Y.

The slide ribs 41 and the springs 42 are held in holders (not shown). By rotating the holders as indicated by the arrow in FIG. 8, using ends adjacent to the springs 42 as pivot fulcrums S and the other end as free ends F, the movable contact separation surfaces 31 are moved to the separation position in the transportation path 19. The slide ribs 41 are slidably held in the holders. The hopper 16, for example, may serve as a holder-rotating unit. The slide ribs 41 and the like can be rotated by attaching the holders to the hopper 16 directly, or indirectly through intermediary members (not shown).

The movable contact separators 32 according to the present embodiment are elastically supported by the springs 42. Thus, when the leading ends 30 of the sheets of paper P contact the movable contact separators 32, the movable contact separators 32 are pushed in the direction of in which the sheets of paper P advance and quickly returned to their original positions. As a result, the leading ends 30 of the sheets of paper P are separated, whereby the sheet separation performance is further improved.

Third Embodiment

Figure 9:
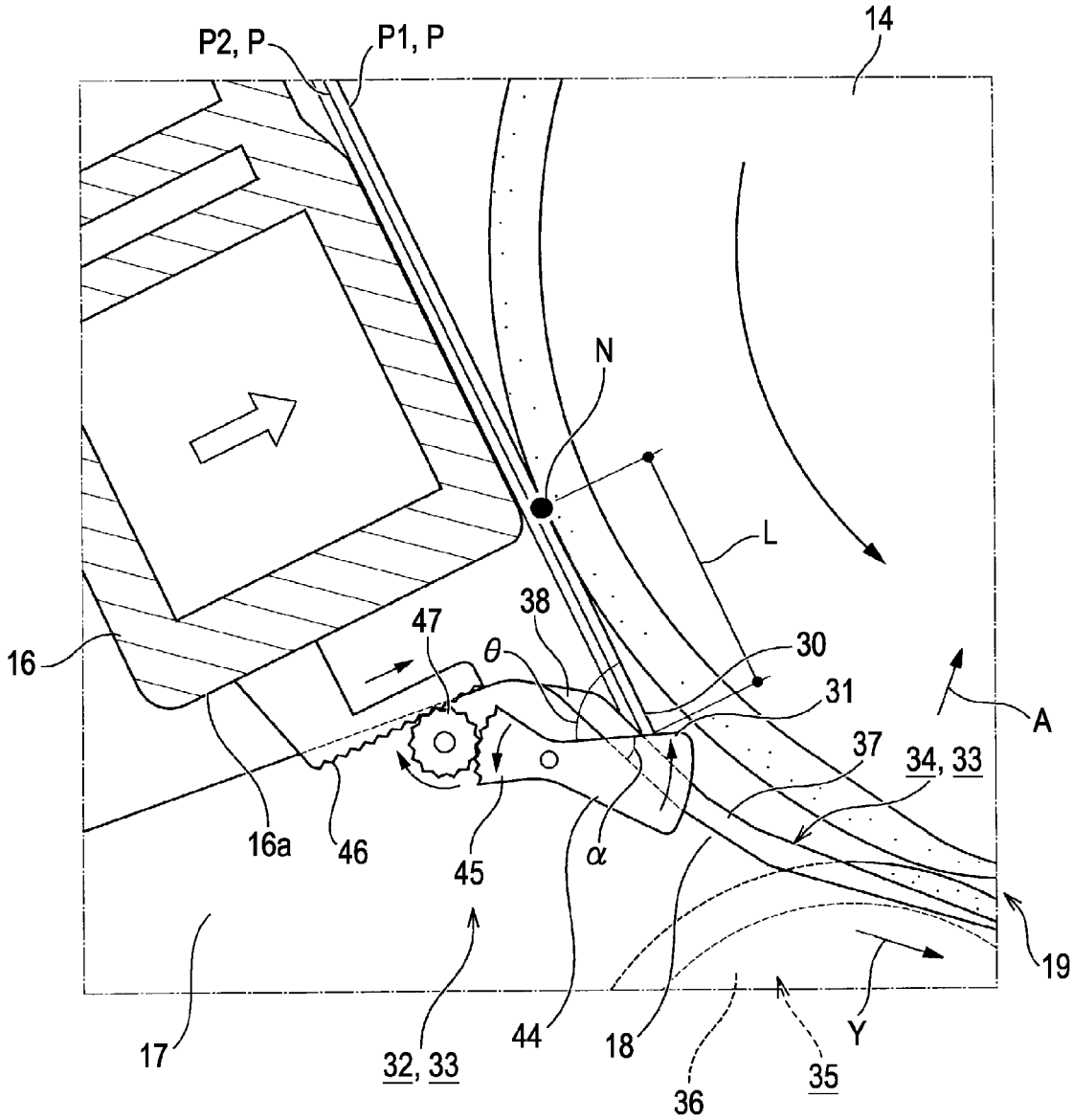
FIG. 9 is a side sectional view of a recording media separating device according to a third embodiment, having a pivotable contact separation surface.

FIG. 9 is a side sectional view of a movable contact separating device according to a third embodiment of the invention, in which the feeding tray holds a few sheets of paper. FIG. 9 shows an operation of the preliminary separator. As the number of sheets of paper P in the feeding tray 5 decreases, the movable contact separation surfaces 31 of the movable contact separators 32 according to the present embodiment are moved in the direction A so as to narrow the transportation path 19 and increase the angle of elevation α. According to the third embodiment, a separating member 44 is pivotably provided on the transportation guide member 17. A part of the separating member 44 constitutes the movable contact separation surface 31, and another part of the separating member 44 constitutes a fan-shaped gear 45. A rack 46 is formed at the free end 16*a* of the hopper 16. The rack 46 serves to pivot the separating member 44 by a predetermined angle, through an intermediate gear 47 provided between the rack 46 and the fan-shaped gear 45.

Fourth Embodiment

Figure 10:
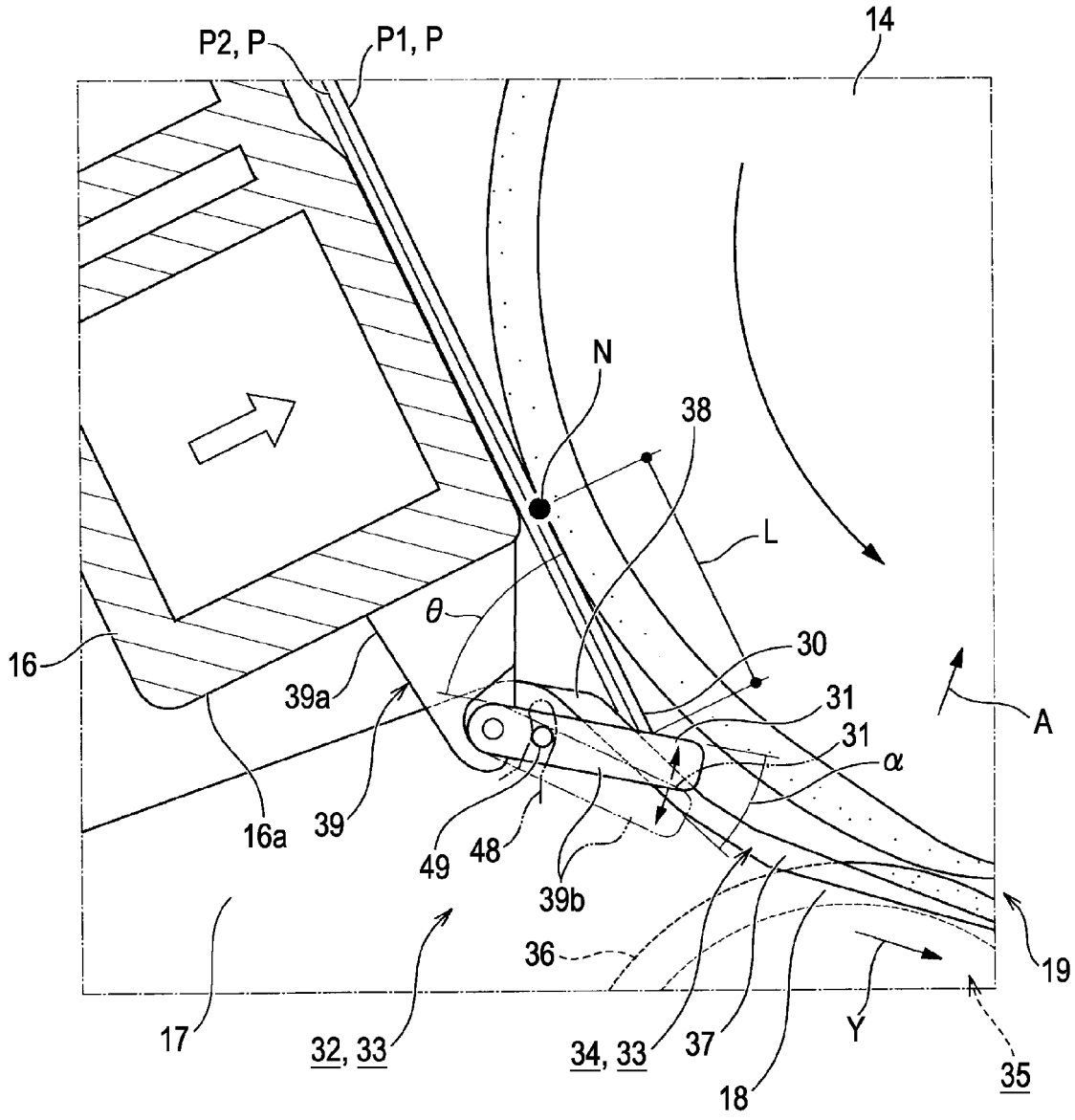
FIG. 10 is a side sectional view of a recording media separating device according to a fourth embodiment, having a pivotable contact separation surface.

FIG. 10 is a side sectional view of a movable contact separating device according to a fourth embodiment of the invention, in which the feeding tray holds a few sheets of paper. FIG. 10 shows an operation of the preliminary separator. As shown in FIG. 10, the base portion 39*a* and the acting portion 39*b* of each of the projections 39 provided at the free end 16*a* of the hopper 16 are separate members. The acting portions 39*b* are pivotable by a predetermined angle. Each of the acting portions 39*b* has an engaging pin 49 that engages with a cam groove 48 provided in the transportation guide member 17. Thus, as the hopper 16 moves upward, the angle of elevation α of the movable contact separation surfaces 31 gradually increases.

Fifth Embodiment

Figure 11:
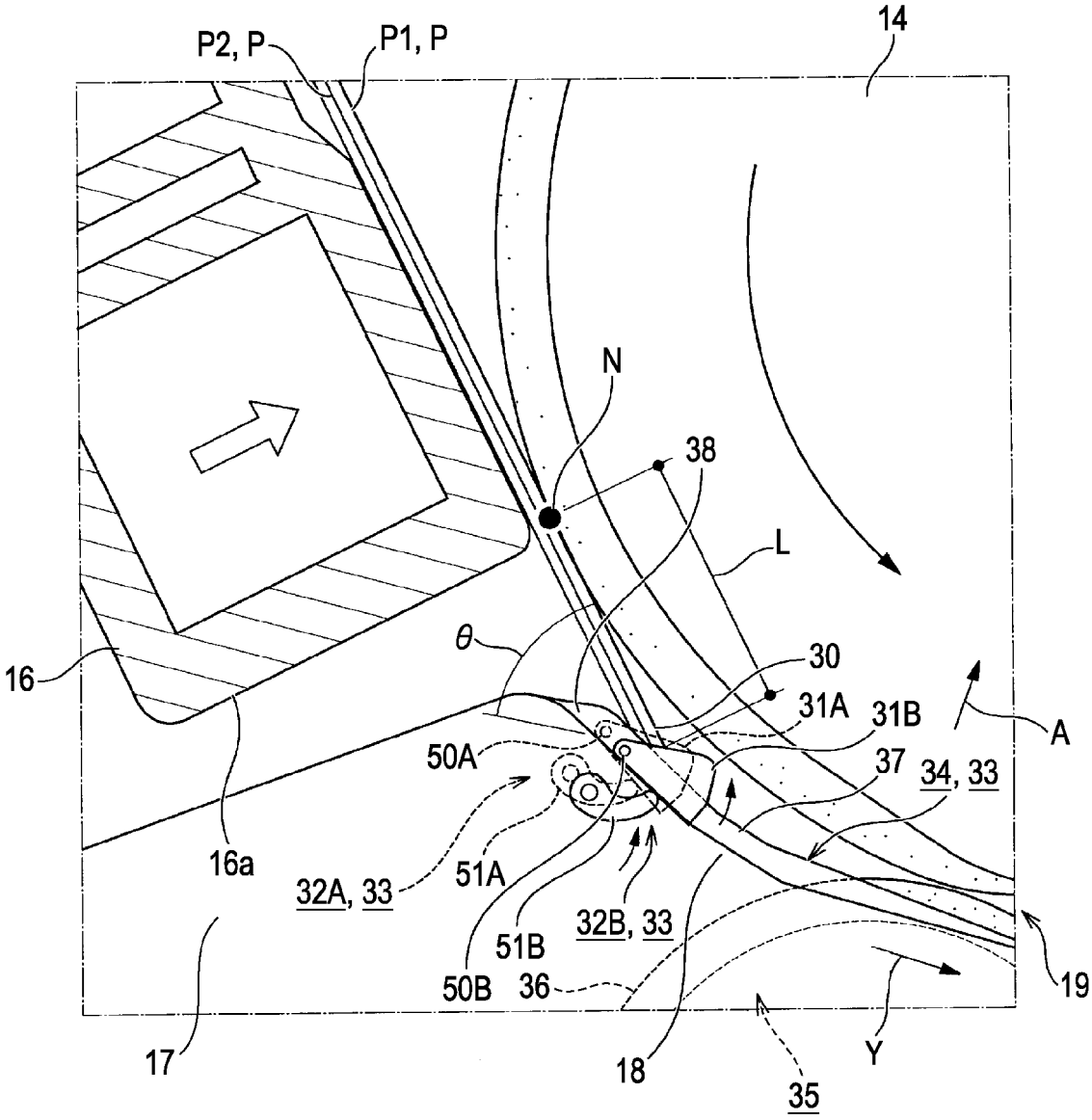
FIG. 11 is a side sectional view of a recording media separating device according to a fifth embodiment, having a plurality of movable contact separators.
Figure 12:
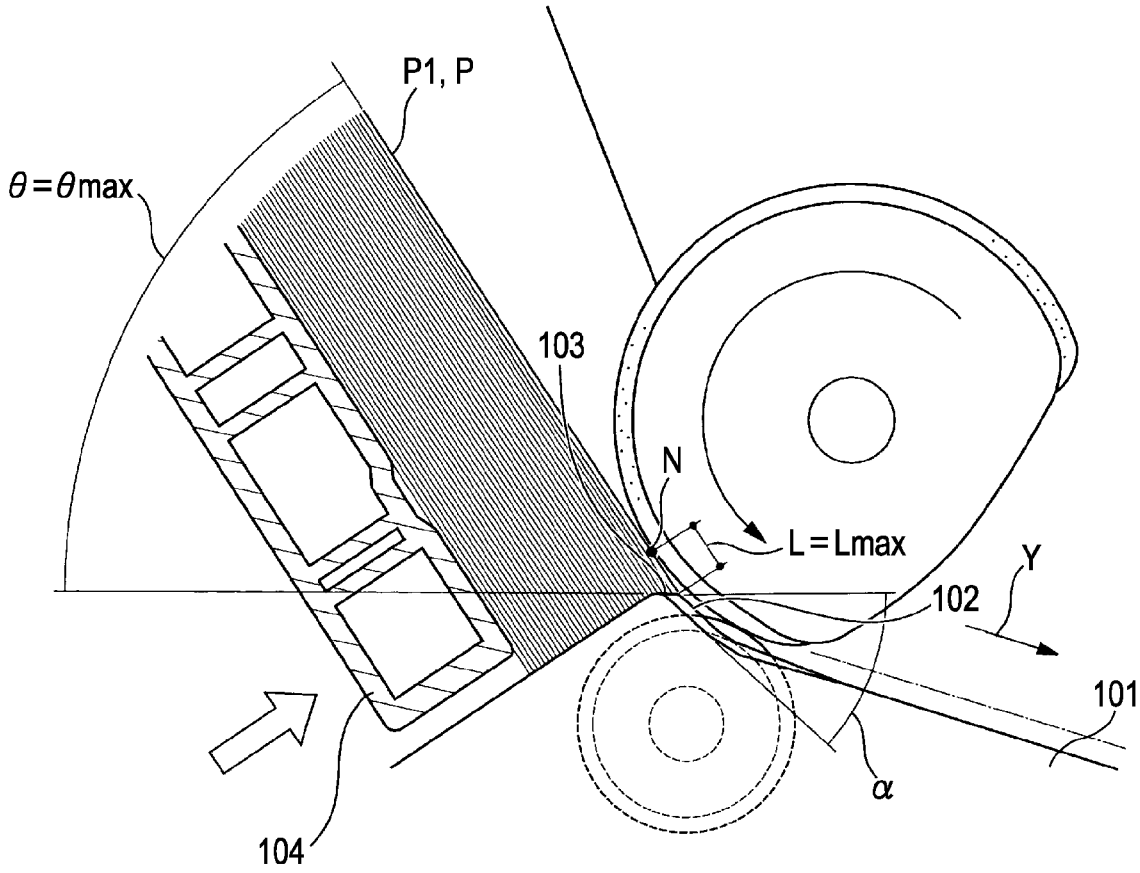
FIG. 12 is a side sectional view of a known preliminary separator, in which a feeding tray holds a large number of sheets of paper.
Figure 13:
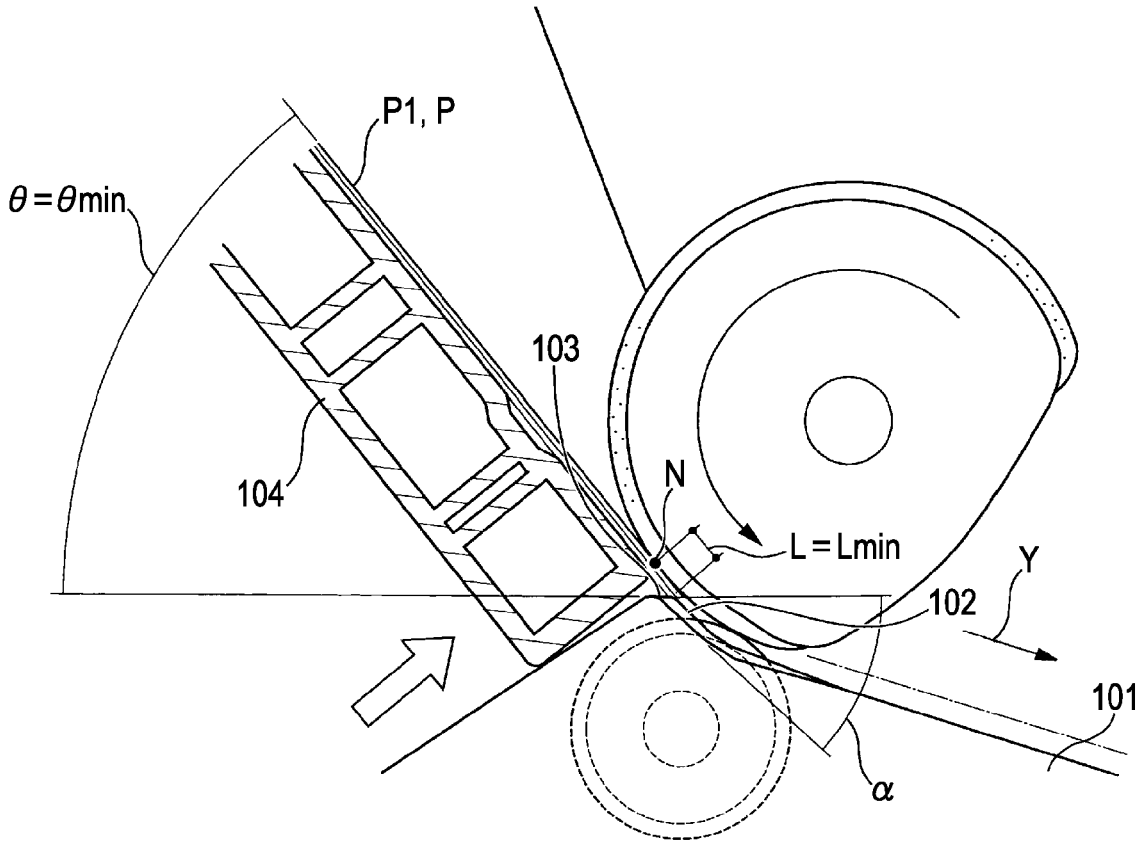
FIG. 13 is a side sectional view of the known preliminary separator, in which the feeding tray holds a few sheets of paper.

FIG. 11 is a side sectional view of a movable contact separating device according to a fifth embodiment of the invention, in which the feeding tray holds a few sheets of paper. FIG. 11 shows an operation of the preliminary separator. A driving unit for moving the movable contact separation surfaces 31 of the movable contact separators 32 is not limited to the hopper 16. An independent driving unit may also be used. Alternatively, a gear train may be provided to transmit the driving force to the hopper 16. More than a pair of the movable contact separators 32 may be provided along the paper transportation direction Y. FIG. 11 shows an example of such an embodiment. A pair of movable contact separators 32A having movable contact separation surfaces 31A, whose angle of elevation α is small, and another pair of movable contact separators 32B having movable contact separation surfaces 31B, whose angle of elevation α is large, are provided at positions shifted from each other, along the paper transportation direction Y. The movable contact separators 32A are provided upstream of the movable contact separators 32B. The movable contact separators 32A and 32B are pivotably connected to the transportation guide member 17 with pivot fulcrums 50A and 50B, respectively. The movable contact separators 32A and 32B are selectively projected in the transportation path 19 by shifting members 51A and 51B, respectively.

Other Embodiments

The recording media separating device of the invention may be used as either the preliminary separator 33 or the main separator 35. The preliminary separator 33 or the main separator 35 may consist of the movable contact separators 32, without the fixed contact separators 34. The recording media separating device of the invention may be used not only in the automatic feeder of the feeding cassette of the ink jet printer 100, but also in the automatic feeders of other recording apparatuses, such as laser printers and photocopiers.

What is claimed is:

1. A recording media separating device that separates recording media fed by a feeding roller and a hopper into a top recording medium and next-to-top recording media, the recording media having been held in a feeding tray before being fed, the recording media separating device comprising;

a movable contact separator having a movable contact separation surface that contacts leading ends of the recording media, wherein, when the number of the recording media held in the feeding tray becomes less than a predetermined number, the movable contact separation surface of the movable contact separator is moved to a separation position in a transportation path for the recording media and wherein when as the number of recording media held in the feeding tray nears the predetermined number, the moveable contact separation surface is moved in a direction that narrows the transportation path.

2. A recording media separating device that separates recording media fed by a feeding roller and a hopper into a top recording medium and next-to-top recording media, the recording media having been held in a feeding tray before being fed, the recording media separating device comprising:

a fixed contact separator having a fixed contact separation surface that contacts leading ends of the recording media, the fixed contact separator being located upstream of a transportation guide member for guiding the recording media from below; and a movable contact separator having a movable contact separation surface that contacts the leading ends of the recording media, the movable contact separator being located downstream of the fixed contact separator, wherein, when the number of the recording media held in the feeding tray becomes less than a predetermined number, the movable contact separation surface of the movable contact separator is moved to a separation position in a transportation path for the recording media and wherein when as the number of recording media held in the feeding tray nears the predetermined number, the moveable contact separation surface is moved in a direction that narrows the transportation path.

3. The recording media separating device according to claim 1, wherein the movable contact separation surface is provided at a projection projecting from a free end of the hopper, which is a swingable structure, in a direction in which the hopper extend.

4. The recording media separating device according to claim 1, wherein, when the movable contact separation surface is positioned at the separation position, the recording media fed by the feeding roller and the hopper contact the contact separation surface of the movable contact separator at an angle within a predetermined range.

5. The recording media separating device according to claim 1, wherein the movable contact separation surface is elastically supported by an urging member.

6. The recording media separating device according to claim 1, further comprising a main separator located downstream of the movable contact separator in a recording media transportation direction.

7. A recording apparatus comprising:

a feeding tray capable of holding a stack of recording media;

a hopper that urges the recording media held in the feeding tray toward a feeding roller;

the feeding roller that cooperates with the hopper to pick up upper recording media; and a recording media separating device that separates the upper recording media into a top recording medium and next-to-top recording media, wherein the recording media separating device is the recording media separating device according to claim 1.

* * * * *